United States Patent [19]

Tribert

[11] Patent Number: 4,944,617

[45] Date of Patent: Jul. 31, 1990

[54] ENCODER EMPLOYING A SHOCK ABSORBING TENSION SPRING

[75] Inventor: John Tribert, Waterloo, Canada

[73] Assignee: NCR Corporation, Dayton, Ohio

[21] Appl. No.: 342,215

[22] Filed: Apr. 24, 1989

[51] Int. Cl.[5] ..... B41J 9/06; B41J 9/20

[52] U.S. Cl. ..... 400/157.2; 400/157.3; 400/388.1; 400/439; 400/436; 101/93.02; 101/93.33; 101/93.47

[58] Field of Search ..... 400/157.1, 157.2, 385, 400/388, 388.1, 439, 157.3, 157.4; 101/93.02, 93.29–93.34, 93.48; 267/179, 180

[56] References Cited

U.S. PATENT DOCUMENTS

| | | | |
|---|---|---|---|
| 794,202 | 7/1905 | Tipton | 267/179 |
| 1,421;083 | 6/1922 | Hess et al. | 400/440 |
| 1,872,872 | 9/1928 | Bendix | 267/180 |
| 2,297,753 | 12/1939 | Emery | 267/180 |
| 2,353,057 | 7/1944 | Mills | 101/93 |
| 2,625,100 | 1/1953 | Williams et al. | 101/93 |
| 4,313,682 | 2/1982 | Theilen | 400/144.3 |
| 4,522,122 | 6/1985 | Mazumder | 101/93.02 |

FOREIGN PATENT DOCUMENTS

| | | | |
|---|---|---|---|
| 2151296 | 3/1981 | Fed. Rep. of Germany | 400/157.2 |
| 0273866 | 11/1987 | Japan | 101/93.32 |
| 0062975 | 11/1914 | Sweden | 400/440 |
| 0720973 | 12/1954 | United Kingdom | 267/180 |

OTHER PUBLICATIONS

IBM Technical Disclosure Bulletin, vol. 24, No. 4, Sep. 1981.

IBM Technical Disclosure Bulletin, vol. 22, No. 12, May 1980.

*Primary Examiner*—Edgar S. Burr

*Assistant Examiner*—John S. Hilten

*Attorney, Agent, or Firm*—Wilbert Hawk, Jr.; Albert L. Sessler, Jr.; Elmer Wargo

[57] ABSTRACT

An encoder having a special construction which includes a special tension spring which increases the life of the encoder. The tension spring has first and second "U"-shaped portions formed on one end thereof with the remaining end of the spring being secured to a frame of the encoder. The first "U"-shaped portion of the spring is positioned around a stud on a beam of the encoder, and the second "U"-shaped portion receives a portion of the beam. An actuator is used to move a hammer on the beam to an impact position, and the tension spring is used to return the beam to a home position. As the beam is moved toward the impact position, there is an increase in the area of contact between the stud and the first "U"-shaped portion to thereby minimize movement therebetween. When the spring returns to the home position, the body portion of the spring assumes an "arched" position which minimizes "bounce" of the beam in returning to the home position.

10 Claims, 3 Drawing Sheets

ENCODER EMPLOYING A SHOCK ABSORBING TENSION SPRING

BACKGROUND OF THE INVENTION (1) Field of the Invention

This invention relates to an encoder having a special construction which includes a shock absorbing spring to extend the life of the encoder.

(2) Background Information

Most fly encoders which are used in printing tend to deteriorate after they have been in operation for a while. A typical application for a fly encoder relates to printing or encoding MICR data on a document as the document is moved along a track or channel. In general, after processing about 200,000 documents in this manner, the encoder may require some adjustment in order to meet the rather strict specifications required for the encoding of MICR data. The adjustment is usually made by technical personnel via a service call. Several such adjustments and re-adjustments may be necessary during the life of the fly encoder.

Another problem with the fly encoders of the type mentioned is that the individual parts of the encoders tend to wear out after about 100 million cycles of operation or after processing about 5 million documents. Aside from the parts becoming "loose fitting", some of the parts actually wear through contacting parts. For example, a coiled tension spring which is used to return the associated print hammer or beam to a home position may actually cut through the beam. Naturally, this results in "down time" for the machine in which the encoder is used, and it also requires another service call.

SUMMARY OF THE INVENTION

In contrast with the problems just mentioned, the encoder of the present invention has a life of about one billion cycles of operation.

Another advantage of the present invention is that there is less wearing of individual parts of the encoder, and consequently, there are fewer service calls to be made when compared to prior art encoders of the type mentioned.

In a preferred embodiment of the invention there is provided an apparatus comprising: a beam having first and second beam end portions; mounting means for mounting said beam for pivotal movement to enable said first beam end portion to be moved between a first position and a second position; a beam stop; a mounting member on said beam; and a tension spring coupled to said beam and said mounting means to resiliently bias said first beam end portion to said first position against said beam stop; said tension spring having a body portion and first and second spring end portions extending from said body portion, with said first spring end portion being secured to said mounting means; said second spring end portion having a first generally U-shaped portion to partially surround said mounting member and also having a second generally U-shaped portion to enable a portion of said beam to be received therein; and said second spring end portion being shaped to cause said body portion of said tension spring to assume an arched position when said first beam end portion is positioned against said beam stop and also being shaped to increase an area of contact between said first generally U-shaped portion and said mounting member as said first beam end portion is moved from said first position toward said second position.

In another aspect of a preferred embodiment of this invention, there is provided a print hammer apparatus comprising: a beam having first and second beam end portions; mounting means for mounting said beam for pivotal movement to enable said first beam end portion to be moved between a home position and an impact area; a beam stop; a stud extending from said beam; a tension spring coupled to said mounting means and said beam to resiliently bias said first beam end portion to said home position against said beam stop; and an actuator coupled to said second beam end portion to pivot said beam to move said first beam end portion from said home position to said impact area when said actuator is energized; said tension spring having a body portion and first and second end portions extending from said body portion, with said first end portion being secured to said mounting means; said second end portion of said tension spring having a first generally U-shaped portion to partially surround said stud and also having a second generally U-shaped portion to enable a portion of said beam to be received therein; and said second end portion of said tension spring being shaped to cause said body portion of said spring to assume an arched position when said first beam end portion is against said beam stop and also to increase an area of contact between said first generally U-shaped portion and said stud as said first beam end portion is moved from said home position toward said impact area.

The above advantages and others will be more readily understood in connection with the following specification, claims, and drawing.

DESCRIPTION OF THE PREFERRED EMBODIMENT

Figure 1:
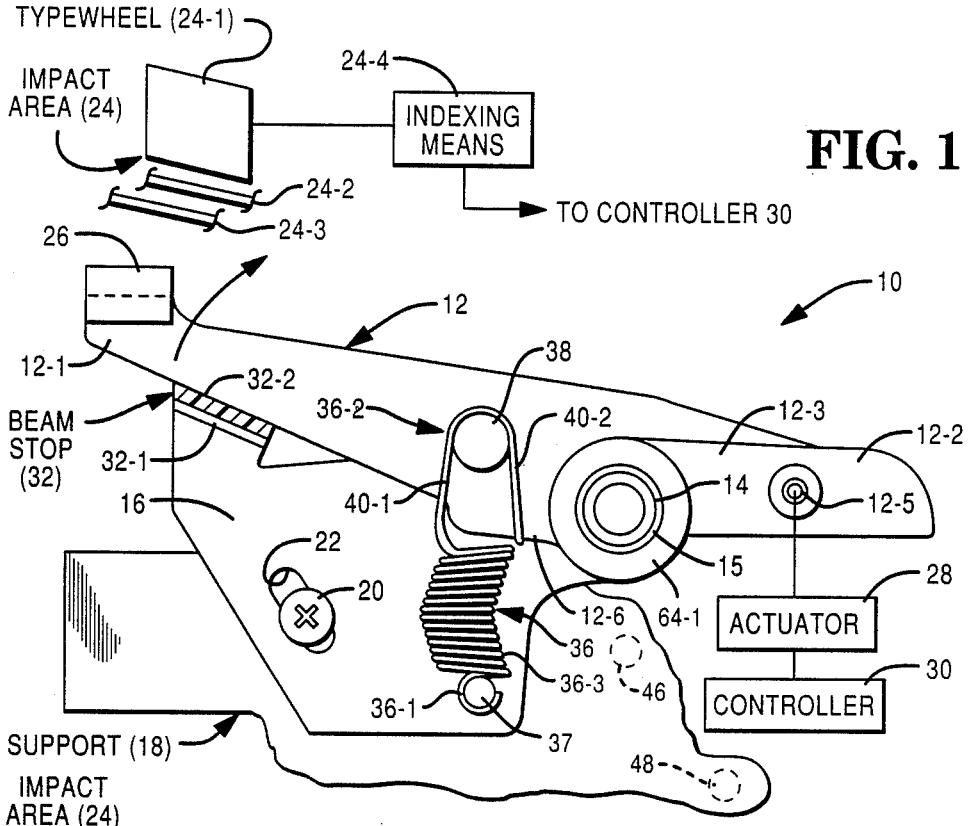
FIG. 1 is a side view of a preferred embodiment of the invention, showing an encoder in a home or first position.

FIG. 1 shows a preferred embodiment of an apparatus like an encoder 10 made in accordance with this invention. The encoder 10 includes a generally planar hammer or beam 12 having the shape shown in FIGS. 1 and 2. The beam 12 has a first beam end portion 12-1 and a second beam end portion 12-2, with the beam 12 being pivotally mounted between these end portions on a pivot member 14.

Figure 2:
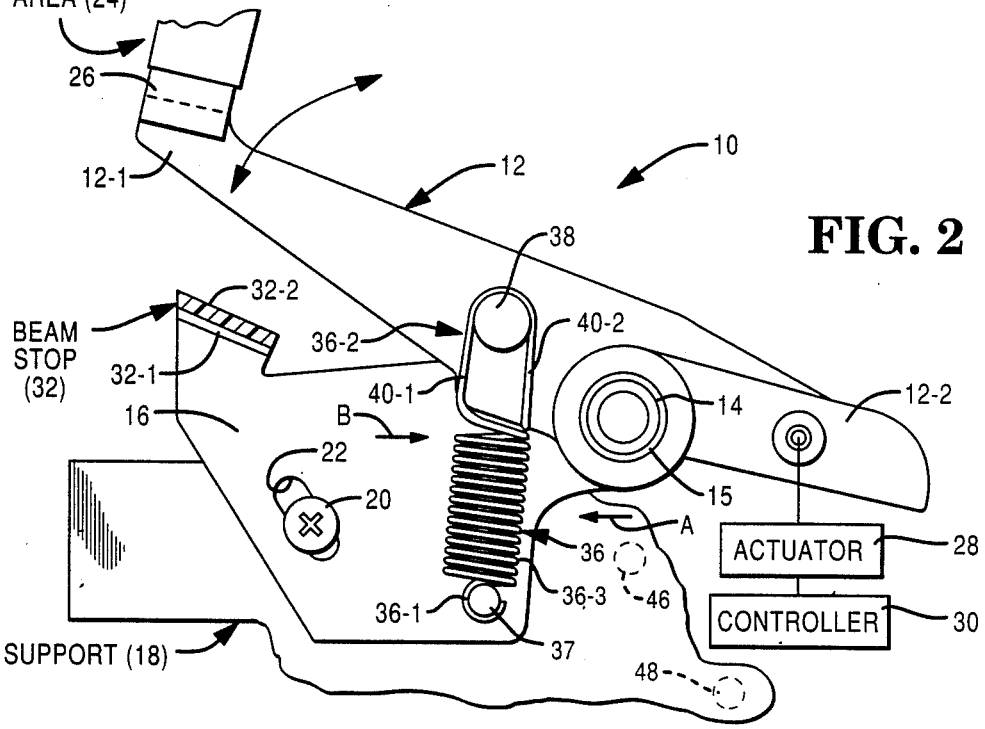
FIG. 2 is a view similar to FIG. 1, showing the encoder in a second or an active position in which the associated hammer strikes an impact area.

The pivot member 14 is part of a means for mounting the beam 12 for pivotal movement between a first or home position shown in FIG. 1 and a second or an impact position shown in FIG. 2. The mounting means also includes a frame 16, with the frame 16 being secured to a support 18 by a fastener 20. The frame 16 is adjustably mounted on the support 18 (via a slot in the frame 16) to provide flexibility in mounting the encoder 10 relative to an impact area 24. The impact area 24 represents or includes a typewheel 24-1, a ribbon 24-2, a document 24-3, and indexing means 24-4 for indexing the typewheel 24-1 to present a preselected character or characters on the typewheel for encoding. The first beam end portion 12-1 has a hammer 26 which impacts against the impact area 24 (FIG. 1) to effect the printing or encoding when an actuator 28 is energized. The actuator 28 and the indexing means 24-4 are controlled by a controller 30 (FIGS. 1 and 2) which may be part of a machine (not shown) like an encoding and proof machine, for example.

The encoder 10 also includes a beam stop 32 which is formed of a flange portion 32-1 of the frame 16 and a resilient member 32-2 which is secured to the flange portion 32-1. When the beam 12 is in the first position shown in FIG. 1, the beam 12 is resiliently biased against the beam stop 32 by a tension spring 36. The design of the tension spring 36 increases the life of the encoder 10 as will be explained hereinafter.

Figure 5:
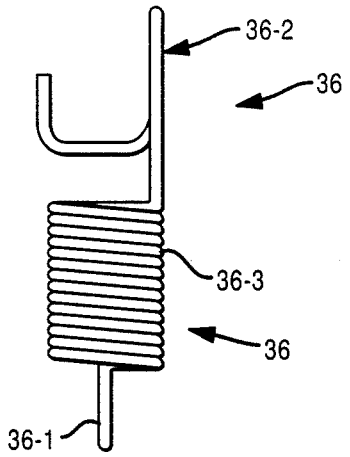
FIG. 5 is a side view of the spring shown in FIG. 3, with the view being taken from the direction of arrow B in FIG. 2.
Figure 4:
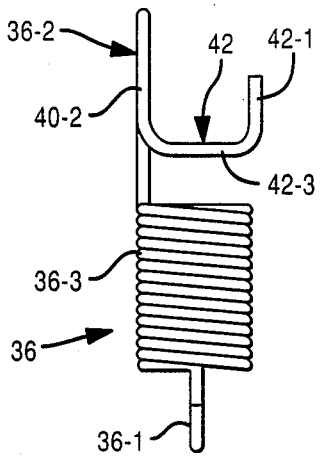
FIG. 4 is a side view of the spring shown in FIG. 3, with the view being taken from the direction of arrow A in FIG. 2.
Figure 3:
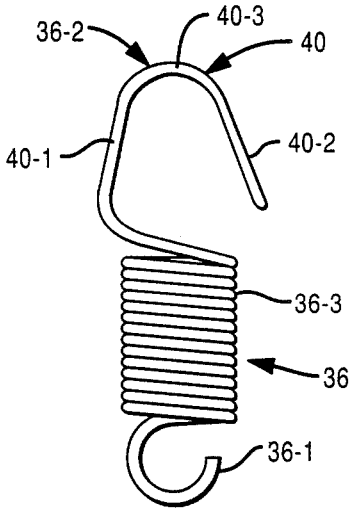
FIG. 3 shows an enlarged view of a spring shown in FIGS. 1 and 2, with the spring being shown in a relaxed state in FIGS. 3, 4, and 5.

FIGS. 3, 4, and 5 show additional details of the tension spring 36 when this spring is in a relaxed state. The spring 36 is shown enlarged in the figures. The spring 36 is made of #8 Gauge music wire (0.5 mm in diameter). In the embodiment described, the free length of the spring 36 is about 19.3mm, with the remaining portions of this spring being drawn to scale. The size of the beam 12 and the tension spring 36 are shown in approximately the correct size relative to each other in FIGS. 1 and 2. Spring 36 has first and second spring end portions 36-1 and 36-2, respectively, which extend in opposed directions from a body portion 36-3 of the spring 36. The first spring end portion 36-1 has a generally "C"-shaped hook thereon which is secured to a mounting stud 37 which extends from the frame 16 as seen in FIG. 1. The second spring end 36-2 is coupled to the beam 12 (via a second stud 38 and a portion 12-6 of the beam 12) to bias the first beam end portion 12-1 to the first or home position as shown in FIG. 1.

In this regard, the second spring end 36-2 of the tension spring 36 is formed to cause the body portion 36-3 to assume an "arched" shape when the spring 36 is mounted on the beam 12 and the first beam end portion 12-1 is positioned against the beam stop 32 as shown in FIG. 1. The shape of the body portion 36-3 is generally convex as viewed from the beam stop 32 in FIG. 1. The function of the arching will become clearer as the explanation proceeds. The second spring end 36-2 has a first generally "U"-shaped portion 40 (FIG. 3) which includes first and second legs 40-1 and 40-2 and a joining portion 40-3, with the first leg 40-1 being connected to the body portion 36-3 of the spring 36. The second spring end 36-2 also has a second "U"-shaped portion 42 (FIG. 4) which includes a first leg 42-1 and the second leg 40-2 which is shared in common with the first "U"-shaped portion 40. A joining portion 42-3 connects the first leg 42-1 and the second leg 40-2 as shown best in FIG. 4. The portion 12-6 of the beam 12 is received in the second "U"-shaped portion 42 when the spring 36 and the beam 12 are assembled as shown in FIG. 1. When in the relaxed state shown in FIG. 3, the leg portions 40-1 and 40-2 diverge away from each other at an angle of about 30 degrees. When the spring 36 is "arched" as shown in FIG. 1, the leg portions 40-1 and 40-2 diverge away from each other at an angle of about ten degrees which is about one third of the relaxed state angle.

Figure 6:
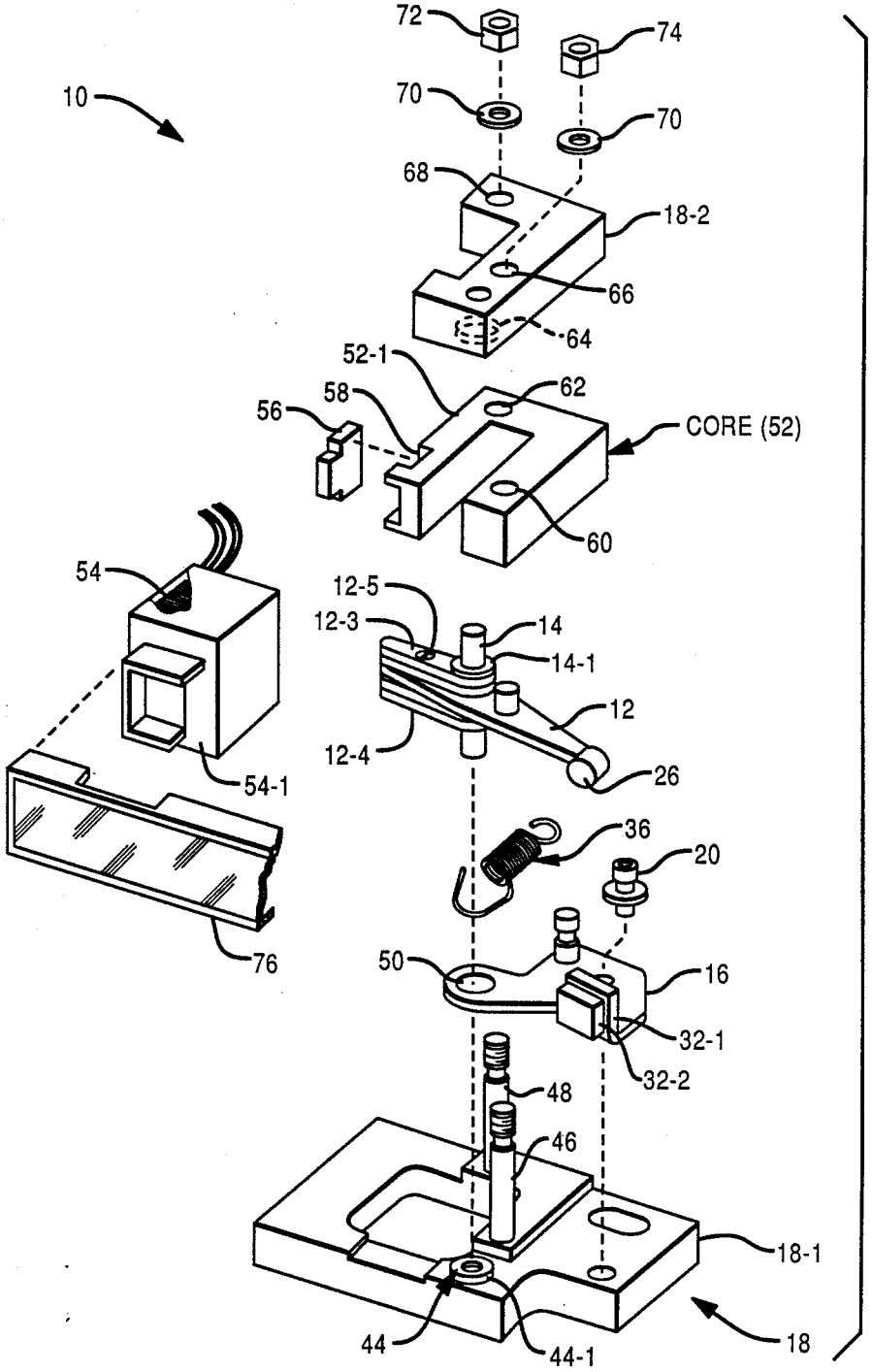
FIG. 6 is an exploded view, in perspective, of the encoder shown in FIGS. 1–5, with this figure also showing some elements not included in FIGS. 1–5.

FIG. 6 is an exploded view, in perspective, of the encoder 10 and its associated elements shown in FIGS. 1–5. The support 18 (shown only schematically in FIGS. 1 and 2) is shown in more detail in FIG. 6. The support 18 includes a lower support member 18-1 and an upper support member 18-2. The lower support 18-1 has a Vespel (Trademark of E.I. Dupont De Nemours) tubular bearing 44 which is press fitted into a mating opening therein so as to leave a short portion 44-1 of the bearing 44 extending above the lower support 18-1. The lower support 18-1 also has two threaded pins 46 and 48 upstanding therefrom as shown in FIG. 6. The pins 46 and 48 are shown in their approximate positions and in dashed outlines in FIGS. 1 and 2 to orient the reader. The Vespel material for bearing 44 is plastic which is as tough as steel. The frame 16 is positioned on the lower support 18-1 so that an opening 50 in the frame 16 is positioned around the short portion 44-1 of the bearing 44, and the fastener 20 is secured to the lower support 18-1 to secure the frame 16 thereto. As best seen in FIG. 6, the beam 12 has several ferrous laminations 12-3 and 12-4 which are positioned on opposed sides of the beam 12 and secured thereto by a fastener 12-5. The laminations 12-3 and 12-4 cooperate with the actuator 28 to move the hammer 26 to the impact area 24 whenever the actuator 28 is energized by the controller 30. The beam 12 is mounted on the frame 16 by inserting the lower end of the pivot member 14 (as viewed in FIG. 6) into the bearing 44. The tension ,spring 36 is then coupled to the beam 12 and the stud 37 as previously described.

Continuing with a discussion of FIG. 6, the actuator 28 (FIG. 1) is made up of a laminated "U"-shaped core 52, a winding 54, and a "T"-shaped element 56 which is made of the same material as is the bearing 44. The "T"-shaped element 56 is positioned in a receiving recess 58 on the core 52, and thereafter, winding 54 is pushed over the leg 52-1 of the core 52. Because the laminations in the core 52 are uneven, the "T"-shaped element 56 provides a straight and durable stop for the second beam end portion 12-2 to keep the beam 12 from rocking when the hammer 26 impacts against the impact area 24 and the beam end 12-2 comes to a stop against the "T"-shaped element 56. After assembly, the actuator 28 is then positioned on the threaded pins 46 and 48 via holes 60 and 62, respectively, in the core 52.

Continuing with a discussion of FIG. 6, the encoder 10 includes the upper support 18-2 which has a Vespel tubular bearing 64 press fitted therein. This bearing 64 has a short portion 64-1 which extends below the bottom surface of the upper support 18-2 as viewed in FIG. 6. The short portion 64-1 (FIG. 1) faces the beam 12. There is an exaggerated clearance 15 shown in FIG. 1 between the pivot member 14 and the short portion 64-1 of bearing 64. The actual clearance 15 is about 0.025 mm in the embodiment described. The bearing 64 receives the upper end of the pivot member 14 (as viewed in FIG. 6) when the upper support 18-2 is mounted on the threaded pins 46 and 48. A thin tubular sleeve 14-1, passing through the laminations 12-3, the beam 12, and the laminations 12-4 and having the ends thereof flattened, functions as a fastener to hold these elements together. The pin 14 is retained in the tubular sleeve 14-1 by press fitting. Holes 66 and 68 in the upper support 18-2 are provided for receiving the threaded pins 46 and 48, respectively, and suitable washers 70 and nuts 72 and 74 are used to secure the encoder 10 in assembled relationship. A dust cover 76, which is coupled to a box 54-1 in which the winding 54 is located, is used to keep dust out of the encoder 10.

In certain prior art encoders, when a spring end like the "C"-shaped end 36-1 (FIG. 1) was placed around a stud on a hammer or beam like the stud 38 on beam 12, the "C"-shaped end would actually cut through the stud 38 after about 48 million cycles of operation. Or alternatively, the "C"-shaped end 36-1 of the spring would be cut through by the stud 38, resulting in down time and a service call to repair the associated encoder. The present invention obviates these problems.

The tension spring 36 has been redesigned to bring about three different kinds of activities, namely:

1. To distribute the load on the beam by directing some of the load to the area 12-6 of the beam 12 which is received by the second "U"-shaped member 42 of the spring 36.
2. To increase the area of contact between the first "U"-shaped portion 40 of the spring 36 and the stud 38 as the beam 12 is moved from the home or first position shown in FIG. 1 to the impact or second position shown in FIG. 2; and
3. To "arch" the body 36-3 of the spring 36 as the beam 12 returns to the first position shown in FIG. 1.

Notice that when the beam 12 is in the first position shown in FIG. 1, the first and second legs 40-1 and 40-2 of the tension spring 36 diverge away from each other at an acute angle of about 10 degrees, and as the beam approaches the impact position shown in FIG. 2, these same legs approach being parallel to each other. The significance of this observation means that the area of contact between the first "U"-shaped portion 40 of the spring 36 and the stud 38 is increasing. This increased contact area means that the spring 36 is gripping more tightly and moving less on the stud 38 (compared to prior art devices), with the result that there is less wear on the spring 36 or the stud 38.

Notice that when the beam 12 is in the impact or second position shown in FIG. 2, the tension spring 36 is subjected to almost pure tension, and the body portion 36-3 thereof is straight. After deenergization of the encoder 10, the beam 12 returns from the position shown in FIG. 2 to the position shown in FIG. 1. In this process, the body portion 36-3 of the spring tends to assume the arched position shown in FIG. 1. The arching of the body portion of the spring 36-1 tends to minimize the "bounce" of the first end portion 12-1 from the beam stop 32 because it appears to take up some rebound energy to bend the body portion 36-3. The "bounce" in prior art devices tended to cause wear on the stud 38 and the spring 36. As the beam 12 returns to the home position shown in FIG. 1, the first and second leg portions 40-1 and 40-2 of the spring 36 tend to diverge away from each other to the position shown, and thereby "arch" the body portion 36-3 of the spring 36.

What is claimed is:

1. An apparatus comprising:

a beam having first and second beam end portions;

mounting means including a pivot member for mounting said beam thereon for pivotal movement to enable said first beam end portion to be moved between a first position and a second position;

a beam stop;

a mounting member on said beam; and a tension spring coupled to said beam and said mounting means to resiliently bias said first beam end portion to said first position against said beam stop;

said tension spring having a body portion and first and second spring end portions extending from said body portion, with said first spring end portion being secured to said mounting means;

said second spring end portion having a first generally U-shaped portion to partially surround said mounting member and also having a second generally U-shaped portion to enable a portion of said beam to be received therein; and said second spring end portion being shaped to cause said body portion of said tension spring to assume an arched position when said first beam end portion is positioned against said beam stop and also being shaped to increase an area of contact between said first generally U-shaped portion and said mounting member as said first beam end portion is moved from said first position toward said second position.

2. The apparatus as claimed in claim 1 in which said mounting member is a cylindrical stud which extends from said beam.

3. The apparatus as claimed in claim 2 in which said first generally U-shaped portion has first and second legs which diverge from each other at a first angle when said first beam end portion is in said first position and in which said first and second legs approach being parallel to each other as said first beam end portion is moved toward said second position to thereby increase said area of contact between said first generally U-shaped member and said cylindrical stud as said first beam is moved toward said second position.

4. The apparatus as claimed in claim 3 in which said mounting member is positioned between said pivoting member and said first beam end portion.

5. The apparatus as claimed in claim 4 in which said apparatus includes an actuator for pivoting said beam to move said first beam end from said first position to said second position against the bias of said tension spring.

6. A print hammer apparatus comprising:

a beam having first and second beam end portions;

mounting means including a pivot member for mounting said beam thereon for pivotal movement to enable said first beam end portion to be moved between a home position and an impact area;

a beam stop;

a stud extending from said beam;

a tension spring coupled to said mounting means and said beam to resiliently bias said first beam end portion to said home position against said beam stop; and an actuator coupled to said second beam end portion to pivot said beam to move said first beam end portion from said home position to said impact area when said actuator is energized;

said tension spring having a body portion and first and second end portions extending from said body portion, with said first end portion being secured to said mounting means;

said second end portion of said tension spring having a first generally U-shaped portion to partially surround said stud and also having a second generally U-shaped portion to enable a portion of said beam to be received therein; and said second end portion of said tension spring being shaped to cause said body portion of said spring to assume an arched position when said first beam end portion is against said beam stop and also to increase an area of contact between said first generally U-shaped portion and said stud as said first beam end portion is moved from said home position toward said impact area.

7. The print hammer apparatus as claimed in claim 6 in which said second generally U-shaped portion extends from said first generally U-shaped portion.

8. The print hammer apparatus as claimed in claim 7 in which said first generally U-shaped portion has first and second legs which diverge from each other at a first angle when said first beam end portion is in said first position and in which said first and second legs approach being parallel to each other as said first beam end portion is moved toward said second position to thereby increase said area of contact between said first generally U-shaped member and said cylindrical stud as said first beam is moved toward said second position.

9. The print hammer apparatus as claimed in claim 8 in which said first and second legs of said first generally "U"-shaped portion diverge away from each other at a predetermined angle when said tension spring is in a relaxed state and in which said first angle is approximately one third of said predetermined angle.

10. The print hammer apparatus as claimed in claim 9 in which said apparatus also includes:

a typewheel located at said impact area;

positioning means for positioning a selected character on said typewheel at said impact area; and a controller for controlling said actuator and said positioning means.

* * * * *